United States Patent [19]

Ueda et al.

[11] Patent Number: 4,969,818

[45] Date of Patent: Nov. 13, 1990

[54] TRUCK FOR FIRING FURNACE

[75] Inventors: Yuzo Ueda, Kaizu; Keiji Yasuda, Aichi, both of Japan

[73] Assignee: NGK Insulators, Ltd., Japan

[21] Appl. No.: 383,274

[22] Filed: Jul. 19, 1989

Related U.S. Application Data

[63] Continuation of Ser. No. 149,391, Jan. 28, 1988, abandoned.

[30] Foreign Application Priority Data

Feb. 6, 1987 [JP] Japan ..... 62-16879[U]

[51] Int. Cl.[5] ..... F27D 3/12

[52] U.S. Cl. ..... 432/241; 414/154; 432/239

[58] Field of Search ..... 432/239, 241; 414/154; 266/274, 276, 277

[56] References Cited

U.S. PATENT DOCUMENTS

| | | | |
|---|---|---|---|
| 1,306,160 | 6/1919 | Zwermann | 432/241 |
| 1,587,210 | 6/1926 | Beecher et al. | 432/241 |
| 1,824,917 | 9/1931 | Morris | 432/241 |
| 3,094,759 | 6/1963 | Herron | 432/241 X |
| 4,315,737 | 2/1982 | Elliott et al. | 432/241 |
| 4,578,031 | 3/1986 | Johnson et al. | 432/241 X |

FOREIGN PATENT DOCUMENTS

| | | | |
|---|---|---|---|
| 1861943 | 7/1967 | Fed. Rep. of Germany . | |
| 1974139 | 12/1967 | Fed. Rep. of Germany . | |
| 3406145 | 9/1985 | Fed. Rep. of Germany . | |
| 2577310 | 8/1986 | France . | |
| 61-13914 | 4/1986 | Japan . | |
| 1158843 | 5/1985 | U.S.S.R. | 432/241 |

*Primary Examiner*—Henry C. Yuen

*Attorney, Agent, or Firm*—Arnold, White & Durkee

[57] ABSTRACT

A truck running on a rail laid in the firing furnace comprises a metallic frame body and a refractory base assembled thereon. At least an outside portion of the refractory base is comprised of car-top bricks each provided at its inward lower part with a foot portion and refractory base bricks located beneath the car-top bricks each provided with an engage portion engaging with a foot portion.

6 Claims, 2 Drawing Sheets

TRUCK FOR FIRING FURNACE

This is a continuation of application Ser. No. 07/149,391 filed Jan. 28, 1988, now abandoned.

Background of the Invention

1. Field of the Invention

This invention relates to a truck running on a rail laid in a firing furnace such as tunnel kiln, shuttle kiln, ring kiln or the like, and more particularly to an improvement in a structure of a truck in which a refractory base mounted onto a metallic frame body of the truck outward from the truck is hard to deform.

2. Related Art Statement

Heretofore, the truck for use in a firing furnace has been comprised of a metallic frame body and a refractory base mounted onto the frame body and made from fireclay bricks having a large density as shown by a transverse cross-sectional view in FIG. 5 and by a side view in FIG. 6. In order to improve heat insulating properties of such a conventional truck, there is known a truck as disclosed, for example, in Japanese Utility Model Application Publication No. 61-13,914.

In the latter truck, a fibrous heat insulating member made from ceramic fibers or the like is attached to the upper surface of the refractory base mounted onto the metallic frame body of the truck, and then the outer surface of the fibrous heat insulating member is covered with a refractory shell member as an outer shell.

Such a truck for use in a firing furnace has excellent heat insulating properties and is useful. However, if it is intended to fire a heavy weight product placed on the refractory base at a firing temperature of about 1,400°C., the refractoriness and high temperature compressive strength of the refractory material may cause problems and the heat insulating material, so that the refractory base in many trucks is generally constructed with the above fireclay bricks.

When the upper portion of the refractory base is made from the fireclay bricks as mentioned above, however, if it is repeatedly subjected to heat hysteresis in firing, the fireclay bricks expand due to the residual expansion of the refractory material to deform the refractory base, particularly to deform the upper surface thereof outward.

Thus, as the refractory base is bulgedly deformed outward, if the truck passes through the firing furnace, the bulged portion of the truck comes into contact with the furnace wall to obstruct the passing thereof. Therefore, it is required to measure the deformation of the truck after certain numbers of passes through the firing furnace. As a result, if the truck having an abnormally deformed portion is found, it is necessary to disassemble the deformed truck and reassemble into a truck of a normal size.

On the other hand, when the shell body of the refractory material covering the fibrous heat insulating member such as ceramic fiber as an outer shell is thin, the shell body deforms because the fibrous heat insulating member such as ceramic fiber or the like becomes susceptible to deformation. Therefore, even when the surrounding of the fibrous heat insulating member such as ceramic fiber or the like is covered with the fireclay bricks, if the portion covered with the fireclay bricks does not have a structure which will prevent deformation, it bulgedly deforms in the same manner as mentioned above to come into contact with the furnace wall of the firing furnace and can not pass through the furnace. As a result, it is also required to disassemble the refractory base of the truck and then reassemble it into a truck of a normal size.

In any case, such an operation takes a great labor and stops the working of the truck for repair and consequently lowers productivity. Therefore, it is demanded to develop a truck for firing furnace having a refractory base which is not considerably deformed even after the passing through the firing furnace many times.

SUMMARY OF THE INVENTION

It is, therefore, an object of the invention to provide a truck for use in a firing furnace which overcomes the aforementioned drawbacks of the conventional techniques.

According to the invention, there is provided a truck for use in a firing furnace the truck running on a rail laid in said firing furnace and comprising a metallic frame body and a refractory base assembled onto said frame body, at least an outside portion of said refractory base comprising car-top bricks having a foot portion located at an inward lower part of said refractory base and refractory base bricks located beneath said car-top bricks and having an engage portion engaged with said foot portion.

BRIEF DESCRIPTION OF THE DRAWINGS

The invention will be described with reference to the accompanying drawings, wherein.

DESCRIPTION OF THE PREFERRED EMBODIMENTS

Figure 1:
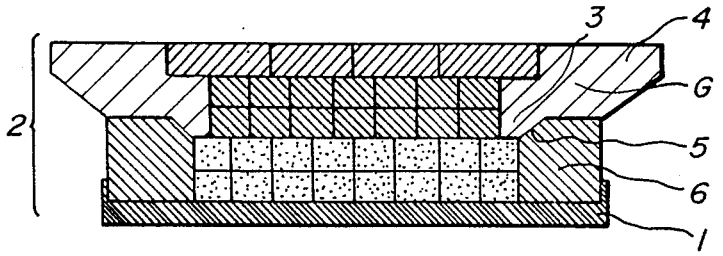
FIG. 1 is a transverse cross-sectional view of an embodiment of the truck for use in a firing furnace according to the invention viewed from a running direction of the truck.

As shown in FIGS. 1 to 4, the truck for use in a firing furnace according to the invention runs on a rail (not shown) laid in the firing furnace. The truck comprises a metallic frame body 1 and a refractory base 2 assembled on the frame body 1. At least an outside portion of the refractory base 2, preferably both outside portions in transverse section of the refractory base 2, is comprised of car-top bricks 4 having a foot portion 3 located at an inward lower part of the refractory base 2, and refractory base bricks 6 located beneath the car-top bricks 4 and having an engage portion 5 engaged with the foot portion 3.

In a preferred embodiment of the invention, the surface of the foot portion 3 engaging with the engage portion 5 is slanted so as to thin the foot portion 3 downward as shown in FIG. 1. Alternately, the joint face between the foot portion 3 and the engage portion 5 has a tenon structure. Furthermore, a heat insulating member 7 made from fireproof fibers and refractory bricks or refractory racks receiving products to be fired are incorporated into portions of the refractory base 2. Moreover, the center of gravity G of the car-top brick 4 is located inward from at least the outside of the metallic frame body 1. And also, the car-top bricks 4 located at both ends in the transverse section of the truck are lapped in at least two stages, or the car-top bricks 4 at both ends in the longitudinal section of the truck are secured to base bricks 6 by the engagement with engage portions 5.

In the truck for use in a firing furnace according to the invention, the outside portion of the refractory base assembled on the metallic frame body, preferably both outside portions in the transverse section of the truck, is comprised of car-top bricks forming the foot portion located at an inward lower part of the refractory base, and refractory base bricks located beneath the car-top bricks and having the engage portion engaged with the foot portion, so that the car-top bricks are engaged so as not to bulgedly deform outward.

The base brick is less vulnerable to the influence of residual expansion and is not deformed even by repetitive heat hysteresis because the bottom portion of the truck is cooled to prevent the rising of the temperature.

In the car-top bricks, the outward bulging deformation is restrained by the base bricks as mentioned above. Furthermore, when the gravity of the car-top brick is located inward from at least the outside of the metallic frame body, car-top bricks do not fall toward the outside of the frame body. This effect is most promoted when heavy products to be fired are placed on the refractory base made from the car-top bricks.

As shown by transverse section of the truck viewed from the running direction thereof in FIG. 1, the base bricks 6 are arranged on the outside portion of the metallic frame body 1 for the truck and the heat insulating bricks are arranged on the central portion thereof.

The car-top bricks 6 are mounted onto the base bricks 4 so as to engage the slant foot portion 3 of the car top brick 4 with the slant engage portion 5 of the base brick 6. In this case, the base brick 6 is made from a fireclay material, while the car-top brick 4 is made from a refractory material having a high refractoriness. Furthermore, the center of gravity G of the car-top brick 4 is located inward from the outer periphery of the metallic frame body 1.

In the inside surrounded by the car-top bricks 4 are fireclay bricks, on which are laid refractory bricks having a high refractoriness to form an upper surface of the refractory base 2.

The truck provided with such a refractory base 2 can be applied to a firing furnace used under a high firing temperature.

Figure 2:
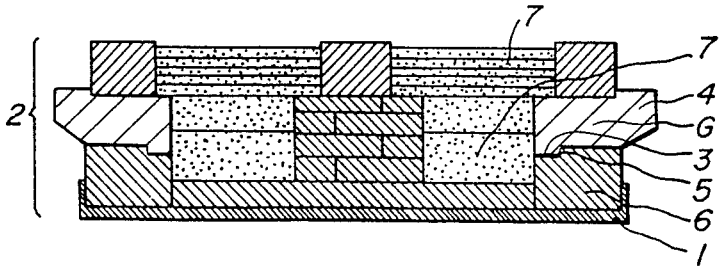
FIG. 2 is a transverse cross-sectional view of another embodiment of the truck for use in a firing furnace according to the invention viewed from a running direction of the truck.
Figure 3:
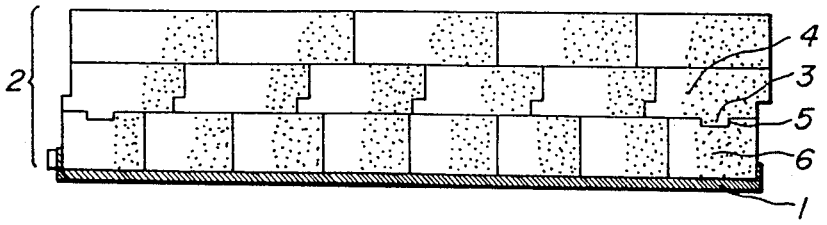
FIG. 3 is a side view of the truck shown in FIG. 2.

In the truck shown by transverse section in FIG. 2 and shown from the side viewing from the running direction in FIG. 3, the foot portion 3 of the car-top brick 4 has a tenon shape and is engaged with the engage portion 5 of the base brick 6 located beneath the bottom of the car-top brick 4 and having a stepwise shape.

The car-top bricks 4 located at front and rear sides in the running direction of the truck, i.e. car-top bricks 4 located at both ends in the longitudinal section of the truck are provided at their bottoms with a convex foot portion 3 engaging with the groove-like engage portion 5 formed in the upper surface of the base brick 6, respectively. By engaging the car-top brick 4 with the base brick 6 through these engage portions, the bulging deformation of the car-top brick 4 in front and rear directions is prevented.

In the central portion surrounded by the car-top bricks 4 is arranged a beam structure formed by assembling fireclay bricks in the running direction.

Furthermore, heat insulating members 7 made from plate-like fireproof fibers are filled between the above beam structure and the car-top bricks located at the outside portion of the refractory base 2.

Although articles to be fired in a kiln are placed on a refractory rack assembled on the beam structure and the car-top bricks 4, the support of this rack is assembled on the beam structure and the car-top bricks, so that the rack is sufficiently durable to the article weight and consequently there is no sinking of the fireproof fiber heat insulating member 7.

Figure 4:
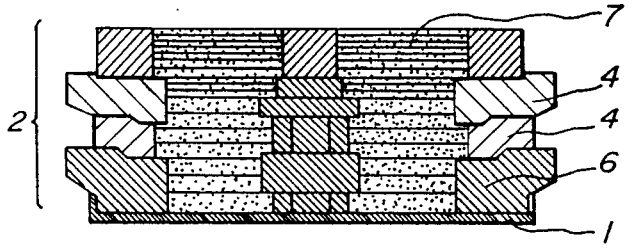
FIG. 4 is a transverse cross-sectional view of another embodiment of the truck for use in a firing furnace according to the invention.
Figure 5:
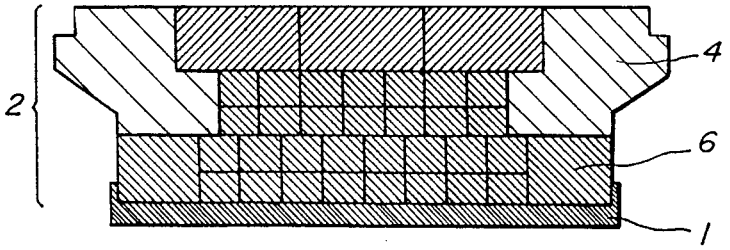
FIG 5 PRIOR ART
FIG. 5 is a transverse cross-sectional view of a conventional truck for use in a firing furnace viewed from a running direction of the truck.
Figure 6:
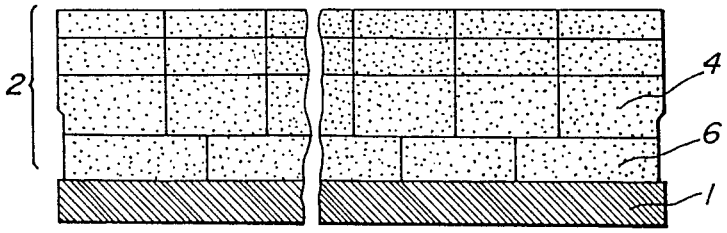
FIG 6 PRIOR ART
FIG. 6 is a partly cutaway side view of the conventional truck shown in FIG. 5.

In the truck of FIG. 4, base bricks 6 each having an engage portion 5 are arranged on the outside portion of the metallic frame body 1. On the base bricks 6 are lower-stage car-top bricks 4 each having engage portions 5 in its upper and lower surfaces so as to engage with the engage portion 5 of the base brick 6. Further, upper-stage car-top bricks 4 each having a foot portion are placed on the lower-stage car-top bricks 4 so as to engage with the engage portion 5 of the lower-stage car-top brick 4.

Fireclay bricks having the same high refractoriness as in FIG. 2 are laid on the upper surface of the upper-stage car-top bricks 4 as an upper face of the refractory base 2, which form a support structure as a refractory rack for supporting articles to be fired.

In the central portion inside the refractory base 2 are heat insulating members 7 made from the same fireproof fibers as in FIG. 2, while a beam structure of refractory bricks is arranged in a portion supporting the refractory for supporting the article to be fired.

Even in the embodiments of FIGS. 1 and 4, it is preferable that the car-top bricks 4 located at both ends in longitudinal section of the truck are engaged with the engage portions 5 of the base bricks 6 as in the embodiment of FIG. 3.

In the truck for use in a firing furnace according to the invention, the car-top bricks located at the outer peripheral portion of the refractory base, particularly at the both outside portions in transverse section of the truck, and the base bricks have such a structure that the outward bulging deformation of the car-top brick is prevented by engagement of the foot portion of the car-top brick with the engage portion of the base brick, so that not only the extent of cooling under the truck necessary for protecting the truck shaft or the like is reduced, but also the bulging deformation of the base brick and car-top brick due to residual expansion is less and the assembling structure is simple and less deformable.

Thus, the assembling structure of the car-top bricks is not deformed, so that even when the truck for use in a firing furnace comprising the refractory base of the above structure according to the invention is repeatedly passed through the firing furnace, the deformation of the refractory base is less time between required repairs becomes longer. Therefore, the number of times the refractory base must be rearranged during the operation of the firing furnace can be reduced.

Furthermore, the shape of the car-top and bricks of the base bricks are simple and assembly is easy, so that rearrangement of the refractory base can be done in a shorter time.

As mentioned above, the invention has many merits and largely contributes to the advancement of this field.

What is claimed:

1. A truck for use in a firing furnace, the truck running on a rail laid in said firing furnace and comprising a metallic frame body and a refractory base assembled onto said frame body, at least an outside portion of said refractory base comprising car-top bricks each having a foot portion located at an inward lower part of said refractory base and refractory base bricks located beneath said car-top bricks, each having an engage portion engaged with said foot portion, a heat insulating member made from fire-proof fibers and refractory bricks receiving products to be fired being incorporated into portions of said refractory base.

2. The truck according to claim 1, wherein a center of gravity of said car-top brick is located inward from at least the outside of said metallic frame body.

3. The truck according to claim 1, wherein a joint face between said foot portion and said engage portion has a tenon structure.

4. The truck according to claim 1, wherein said car-top bricks located at both ends in the transverse section of the truck are lapped in an up and down direction in at least two stages.

5. The truck according to claim 1, wherein said car-top bricks at both ends in the longitudinal section of the truck are secured to said base bricks by engagement with said portions.

6. A truck for use in a firing furnace, the truck running on a rail laid in said firing furnace and comprising a metallic frame body and a refractory base assembled onto said frame body, at least an outside portion of said refractory base comprising car-top bricks each having a foot portion located at an inward lower part of said refractory base and refractory base bricks located beneath said car-top bricks, each having an engage portion engaged with said foot portion, each foot portion having a surface, the surfaces of said foot portions engaging with said engage portion being slanted so as to thin said foot portion downward.

* * * * *